US006006390A

United States Patent [19]

Bischel et al.

[11] Patent Number: 6,006,390

[45] Date of Patent: Dec. 28, 1999

[54] CONNECTING MECHANISM FOR ATTACHING A GROUND-ENGAGING SURFACE MAINTENANCE IMPLEMENT TO A TRACTION VEHICLE

[75] Inventors: Randall J. Bischel, Bloomington; Daniel E. Peterson, Northfield; Gaylord M. Pahl, Excelsior, all of Minn.

[73] Assignee: The Toro Company, Bloomington, Minn.

[21] Appl. No.: 08/963,598

[22] Filed: Oct. 31, 1997

[51] Int. Cl.[6] ..... E01H 1/02

[52] U.S. Cl. ..... 15/82; 15/83; 15/340.3

[58] Field of Search ..... 15/82, 83, 78, 15/340.3, 340.1; 37/231, 234, 247, 283; 172/677, 679, 680

[56] References Cited

U.S. PATENT DOCUMENTS

| | | | |
|---|---|---|---|
| 2,212,677 | 8/1940 | Wagner | 15/82 |
| 2,330,025 | 9/1943 | Bentley et al. | 15/82 |
| 3,624,853 | 12/1971 | Kromer | 15/82 |
| 3,886,624 | 6/1975 | Landesman et al. | 15/340 |
| 4,037,284 | 7/1977 | McDonald | 15/83 |
| 4,667,365 | 5/1987 | Martinek | 16/35 |
| 5,016,310 | 5/1991 | Geyer | 15/49.1 |
| 5,231,725 | 8/1993 | Hennessey et al. | 15/83 |
| 5,245,771 | 9/1993 | Walsh | 37/269 |
| 5,279,014 | 1/1994 | Wise | 15/82 |
| 5,426,805 | 6/1995 | Fisher | 15/79.2 |
| 5,493,795 | 2/1996 | Bail | 37/104 |
| 5,515,568 | 5/1996 | Larson et al. | 15/50.3 |
| 5,560,065 | 10/1996 | Young | 15/82 |

FOREIGN PATENT DOCUMENTS

| | | |
|---|---|---|
| 41 35 667 A1 | 5/1993 | Germany . |
| 2 246 391 | 1/1992 | United Kingdom . |

*Primary Examiner*—Elizabeth McKane
*Attorney, Agent, or Firm*—R. Lawrence Buckley

[57] ABSTRACT

The present invention relates to an improved mechanism (100) for attaching a ground-engaging surface maintenance implement, preferably a front-mounted rotary sweeper (300), to a traction vehicle (200). The mechanism includes a four-bar linkage (102) to "yaw" the implement from an initial position, where the sweeper brush axis is generally perpendicular to the longitudinal axis of the traction vehicle (200), to a first or second position, characterized by the brush axis assuming an angled (i.e., non-perpendicular) orientation, the first and second positions being equal but opposite to one another. The mechanism further includes a central pivot (104) which permits the implement to "roll" or rotate preferably about a horizontal axis perpendicular to the brush axis such that the sweeper (300) can maintain ground contact across its lateral width when traversing laterally uneven terrain. The preferred mechanism also includes a force-producing device (148), selectively activated by the operator, to translate the implement from its initial position to the first or second position or anywhere in-between. Finally, the preferred embodiment of the present invention includes ground-contacting caster-wheels (318) to support or partially support the weight of the sweeper and therefore relieve the weight borne by the sweeper brushes (304).

18 Claims, 10 Drawing Sheets

148
168
166
328
164
162
173
330
170
171
176
174
178
172
180
326
160
PTO
158
124
156

CONNECTING MECHANISM FOR ATTACHING A GROUND-ENGAGING SURFACE MAINTENANCE IMPLEMENT TO A TRACTION VEHICLE

FIELD OF THE INVENTION

This invention relates generally to mechanisms for attaching ground-engaging surface maintenance implements to traction vehicles, and more particularly to an improved mechanism for connecting a front-mounted rotary sweeper to a traction vehicle.

BACKGROUND

Although the present invention can be utilized with a wide variety of ground-engaging surface maintenance implements, such as dozer blades or grass dethatchers for example, it is particularly advantageous when used with rotary sweepers. A typical rotary sweeper comprises a series of disc-shaped brushes mounted on a common, horizontally transverse brush shaft, the brushes effectively forming a large, cylindrical sweeper. Such sweepers are commonly used to clean hard surfaces (e.g., roads, sidewalks, parking lots) of dirt, snow, or other loose debris. By operatively connecting the brush shaft to a power source (e.g., motor), the shaft can be selectively rotated about its axis, forcing the brushes to spin. Engaging the spinning brushes with the ground produces the desired sweeping action. The sweeper itself is connected to a traction vehicle which is capable of moving the sweeper across an unswept surface. While many rotary sweepers are incorporated into "dedicated" vehicles (e.g., street sweepers), the preferred embodiment of the present invention pertains to those detachably mounted to the front of a multi-purpose traction vehicle. This invention specifically relates to the way in which the sweeper is connected to such a vehicle.

While several implement connecting mechanisms are known in the art, few have proven well-suited for use with front-mounted rotary sweepers. This is attributable to two peculiar characteristics of these sweepers. First, the range of motion necessary to effectively operate a sweeper is more complex than that required for other implements. Second, unlike other implements, the ground-contacting elements of a rotary sweeper are subject to rapid and continual wear during use. The sweeper connecting mechanism must be capable of accommodating this wear without adversely affecting either sweeper performance or range of motion. Each of these particular problems is discussed below.

Sweeper Range of Motion

Rotary sweepers operate most effectively when the sweeper is adjustable over a wide range of motion. That is, the connecting mechanism should provide the necessary "degrees of freedom" to permit versatile positioning of the rotary sweeper relative to the vehicle. To take advantage of aviation terms to describe these various motions, the preferred degrees of freedom would include "yawing" (pivoting about a substantially vertical axis); "rolling" (pivoting about a generally horizontal axis perpendicular to the brush shaft axis); and "pitching" (pivoting about a laterally horizontal axis generally perpendicular to the longitudinal axis of the vehicle). Motion of the sweeper about any one axis should not interfere with movement about either other axis. Similarly, the range of motion should be unaffected by changes in connecting mechanism geometry due to sweeper wear (further discussed below).

Assuming the initial position of the rotary sweeper is such that it sweeps straight ahead (e.g., the brush shaft axis is perpendicular to the longitudinal axis of the vehicle), yawing permits the sweeper to translate or pivot about a substantially vertical axis so that the brush shaft axis assumes an angled (i.e., non-perpendicular) orientation relative to the longitudinal axis of the vehicle. Adjustable yaw allows the operator to control the direction of debris discharge independent of vehicle direction. Ideally, sweeper yaw is adjustable such that it can sweep to the left (yaw left), to the right (yaw right), or anywhere in between.

When the sweeper encounters a surface that is laterally sloping or irregular, it is preferable that the sweeper pivot or roll about a substantially horizontal axis perpendicular to the brush axis shaft. This "rolling" motion improves performance by allowing the sweeper to maintain ground contact across its lateral width. Thus, the need for repeated passes over the same area is reduced or eliminated.

Lastly, it is desirable for the rotary sweeper to "pitch" about an axis which is laterally horizontal to the vehicle. This motion accomplishes two objectives. First, when not in operation, pitching the sweeper to an "up" position assists in transporting the sweeper from one site to the next. Second, during operation, the ability to "float" about the pitch axis permits the sweeper to effectively follow ground contours regardless of the differential elevation of the vehicle.

Sweeper Wear

Rotary sweepers are unique compared to other ground-engaging implements in that the sweeper element itself is subject to continual wear. This constant wear necessitates a specialized connecting mechanism. As previously mentioned, the sweeper is defined by a series of brushes aligned on a common brush shaft. Each brush comprises a plurality of radially extending flexible filaments that perform the sweeping task. Unlike other implements, the brush filaments of the rotary sweeper are sacrificial and are subject to constant wear due to abrasive contact with the ground. As the filaments wear, the diameter of the sweeper is reduced. However, effective sweeping is possible even at significantly reduced brush diameters. Therefore, the preferred connecting mechanism accommodates reduced brush diameters without adversely affecting performance or range of motion.

Another factor accelerating sweeper wear is brush loading. If the floating weight of the sweeper is supported solely or substantially by the brushes, excessive brush filament wear will occur. Thus, it is preferable to incorporate a load-supporting means into the connecting mechanism to control the loading of the brushes.

While several connecting mechanisms have been tried in the past, the applicants are aware of two that particularly address the unique operational requirements of the rotary sweeper. The first is the simple "vertical axis pivot" as shown in U.S. Pat. No. 2,330,025 to Bentley. The second is the more elaborate four-bar linkage connecting mechanism currently used by M-B Companies, Power Broom Division (hereinafter referred to as M-B), on its model MLT-CT. Although both are commendable for solving long-standing problems, shortcomings are evident with each design. The Bentley vertical axis pivot and the M-B design are separately discussed below.

Vertical Axis Pivot

A common approach to yawing the sweeper is to provide a vertical axis pivot about which the sweeper assembly may rotate (i.e., yaw). An example of a rotary sweeper utilizing this connecting mechanism is shown in the Bentley patent and depicted in FIGS. 12, 13, and 14 herein. In this reference, the rotary sweeper assembly yaws by pivoting about axis "II." The Bentley patent also discloses a connecting mechanism that permits rolling and pitching of the sweeper about axes "I" and "III" respectively.

Accordingly, Bentley discloses a connecting mechanism that provides the desired degrees of freedom. Additionally, Bentley is notable for providing sweeper support (not shown in FIGS. 12–14) to reduce bristle loading and thus lessen brush filament wear. Nevertheless, the simple vertical axis pivot has a significant drawback. In order to achieve acceptably large yaw angles, the sweeper must be placed sufficiently forward of the vehicle such that, when pivoted to its maximum yaw position, the rear edge of the sweeper will not contact the vehicle. But placing the sweeper far forward of the vehicle requires a connecting mechanism of increased length. This additional mechanism length is undesirable for several reasons. First, it increases the total weight of the implement assembly and places that weight farther forward of the vehicle. This makes the vehicle/implement combination longer and less maneuverable during operation. More importantly, this additional weight can adversely affect the stability of the vehicle when the sweeper is in the "up" or transport position. Second, as the distance from the vertical axis pivot to the sweeper grows, the rotational radius of the sweeper about the vertical axis pivot also increases. The end result is that, when pivoted to its maximum yaw position, the center of the yawed sweeper becomes laterally offset from the center of the vehicle. That is, the sweeper no longer clears a path directly in front of the vehicle, but rather clears a parallel, offset path. When this occurs, the vehicle tires will contact unswept ground, compacting the debris and making effective sweeping more difficult. Possible solutions to this problem include reducing the effective yaw angle, thus reducing the offset; or increasing the width of the sweeper, thus ensuring that the vehicle width is always swept. Neither of these options is desirable.

As such, there are problems associated with the simple vertical axis pivot. These drawbacks are addressed to some degree by the more complex four-bar linkage connecting mechanism used by M-B and discussed below.

Four-Bar Linkage

The four-bar linkage connecting mechanism (i.e., the M-B design) shown in FIGS. 9, 11, 11A, and 11B herein, theoretically improves upon the simple vertical axis pivot connecting mechanism, discussed above, in several respects. Noting the drawings are not necessarily to scale, FIG. 11 discloses a rotary sweeper attached to a vehicle (not shown) with a four-bar linkage wherein a front crossbar A supports the sweeper and a base link B is fixed to the vehicle. Pivotably connected between front crossbar A and base link B is a pair of left and right links C and D. Pivot joints E, F, G and H connect the respective members. FIG. 9 shows this same linkage in simplified form. A hydraulic cylinder J connects base link B and right link D at attachment points K and L respectively. Extension and retraction of hydraulic cylinder J forces right link D to pivot about joint H drawing crossbar A (and thus the attached sweeper) and left link C through their defined range of motion. Accordingly, displacing the hydraulic cylinder "translates" the linkage, thereby yawing the sweeper. Note that, per FIGS. 9 and 11, retracting hydraulic cylinder J causes the four-bar linkage to rotate to the left (i.e., counterclockwise). When this occurs, the rotary sweeper itself actually yaws to the right. Similarly, extension of cylinder J causes the four-bar linkage to rotate to the right (i.e., clockwise), causing the sweeper to yaw to the left. Table IV shows the approximate lengths, dimensions, and angles of the M-B four-bar linkage. Refer to FIG. 9 for more information.

TABLE IV

FIG. 9
Dimensional Data

| Item | Value |
|---|---|
| A | 9.25 in |
| B | 15.25 in |
| C, D | 17.40 in |
| M | 3.00 in |
| N | 100° |
| N' | 41° |
| N" | 166° |
| P | 80° |
| P' | 108° |
| Q | 30° |

Translational motion of the linkage described above is advantageous to the rotational motion of the simple vertical axis pivot for two reasons. First, it allows the sweeper to achieve a given yaw angle while keeping its lateral width more closely centered about the longitudinal axis of the vehicle. Accordingly, the lateral offset problem inherent with the vertical axis pivot is reduced. Second, the more efficient motion of the four-bar linkage allows attachment of the sweeper in closer proximity to the vehicle, therefore reducing the overall length and weight of the connecting mechanism.

However, unresolved issues remain with the M-B four-bar linkage. For example, referring to FIG. 11, the mechanism permits yawing and pitching of the sweeper but not rolling. Without rolling capability, the sweeper cannot traverse laterally uneven surfaces without sacrificing sweeper effectiveness. But more importantly, this lack of rolling freedom is particularly detrimental once the sweeper brushes begin to wear. With new brushes installed, the plane of the four bar linkage is substantially parallel to the ground. Since translation of the four-bar linkage occurs only within the plane of the linkage itself, yawing of a sweeper with new brushes is not problematic. However, as the brushes wear, the sweeper must be lowered (i.e., the forward end of the connecting mechanism must be pitched downward) to maintain proper brush/ground contact. When this occurs, the plane of the four-bar linkage, as shown in FIG. 11A, is no longer parallel to the ground. Without this parallel relationship, yawing of the sweeper from the straight ahead position causes the trailing edge of the sweeper to elevate and the leading edge to drop. See FIG. 11B where the trailing edge is to the right. This forces the brushes at the leading edge of the sweeper to engage the ground at a higher contact pressure than those at the trailing edge. The end result is uneven or "conical" wear of the sweeper. This wear pattern significantly reduces the life of the brushes and hampers effective sweeping in subsequent yaw positions.

Another problem with the M-B mechanism depicted in FIGS. 9 and 11 results from the location of hydraulic cylinder J. As with most hydraulic cylinders, mounting of the cylinder such that it can efficiently transfer force is highly desirable. For example, attaching the cylinder so that it acts generally perpendicular to link D as shown in FIG. 9 will ensure optimal force transfer from the cylinder to the four-bar linkage. Additionally, placing attachment point L away from pivot H (i.e., increase dimension M), increases the mechanical advantage of cylinder J. That is, by placing attachment point L closer to pivot F, cylinder J requires less force to translate the four-bar linkage than if attachment point L is placed close to pivot H. Unfortunately, by restricting the physical location of attachment point K to stationary link B, it is difficult to obtain improved mechanical advantage while maintaining the perpendicular relationship between cylinder J and link D. The M-B four-bar linkage sacrifices mechanical advantage in favor of maintaining the desired perpendicularity. As such, the force required to extend and retract cylinder J is higher than it would be if attachment point L were located proximate to pivot F. To generate this larger force without increasing cylinder size, it is necessary to increase the threshold (or minimum) pressure required to extend and retract the cylinder.

The disadvantage resulting from this higher threshold pressure is that the hydraulic cylinder may be unable to move (i.e., no yaw ability) when the sweeper is in its raised position. This is attributable to the fact that the hydraulic cylinder shares a parallel hydraulic pressure source with the sweeper motor (i.e., the hydraulic motor that spins the brush shaft). As such, supply pressure to the cylinder is dependent on the simultaneous hydraulic requirements of the sweeper motor. If the hydraulic resistance of the sweeper motor (including the resistance of the attached brush) is very low, the pressure within the hydraulic system is lessened. The resistance of the sweeper motor is at a minimum when it is in a "no-load" condition; i.e., when the sweeper is raised. Thus, if the hydraulic cylinder has a threshold pressure higher than the system pressure in the no-load condition, it is not possible to yaw the raised sweeper. Rather, hydraulic resistance of the sweeper motor must first be increased by lowering the sweeper into contact with the ground. This sequence is undesirable as the operator often prefers to yaw the sweeper to one side or the other prior to engaging it with the ground.

Another problem with the M-B design is the absence of overload protection for the hydraulic cylinder. When the M-B sweeper encounters an immovable object during operation, the external load applied to the sweeper must be partially reacted through cylinder J. The resultant load that must be reacted by the cylinder may easily exceed the maximum design load of the cylinder (i.e., the load expected during normal operation). When this occurs, critical components including but not limited to cylinder J, and attachment points K and L may fail.

Accordingly, the M-B four-bar linkage, while an improvement over prior mechanisms, has unresolved problems.

The present invention addresses the issues associated with the prior art connecting mechanisms. In particular, the connecting mechanism of the present invention provides a more compact design that provides improved brush life, eliminates uneven brush wear, provides better terrain following, provides cylinder overload protection, and allows yawing of the sweeper in the raised position.

SUMMARY OF THE INVENTION

Accordingly, one embodiment of the present invention includes a ground-engaging surface maintenance implement; an improved translatable four-bar linkage permitting yawing of the implement; and a central pivot permitting rolling of the implement.

In a preferred embodiment, the implement is a transversely mounted, ground-engaging rotary sweeper comprising a plurality of radial brushes. The sweeper is preferably attached to the front of a traction vehicle with the four-bar linkage situated proximate to the vehicle and the central pivot disposed intermediate to the four-bar linkage and the rotary sweeper.

The invention may also include a means for yawing the implement by selective translation of the four-bar linkage.

The invention may additionally include ground-engaging caster wheels to relieve the brushes from excessive loading.

Another aspect of the preferred embodiment of the present invention is directed to a hydraulic subsystem including a hydraulic reservoir; a hydraulic pump operatively connected to the reservoir; a hydraulic motor operatively connected to the hydraulic pump, wherein the motor provides rotational power to the rotary sweeper; and a hydraulic cylinder, wherein the cylinder provides selective translation of the four-bar linkage and thus, yawing of the sweeper.

In a preferred embodiment, the hydraulic subsystem includes an orifice between the hydraulic pump and the cylinder, wherein flow across the orifice generates a pressure drop, effectively reducing the flow rate to the cylinder. This reduced flow slows the translation speed of the four-bar linkage and prevents erratic motion of the sweeper by reducing pressure "surges" within the subsystem.

Additional aspects of the present invention are described in detail below with reference to the Drawings.

BRIEF DESCRIPTION OF THE DRAWINGS

FIG. 3 is an enlarged right side view of the rotary sweeper connecting mechanism of FIG. 2.

DETAILED DESCRIPTION OF THE INVENTION

Figure 1:
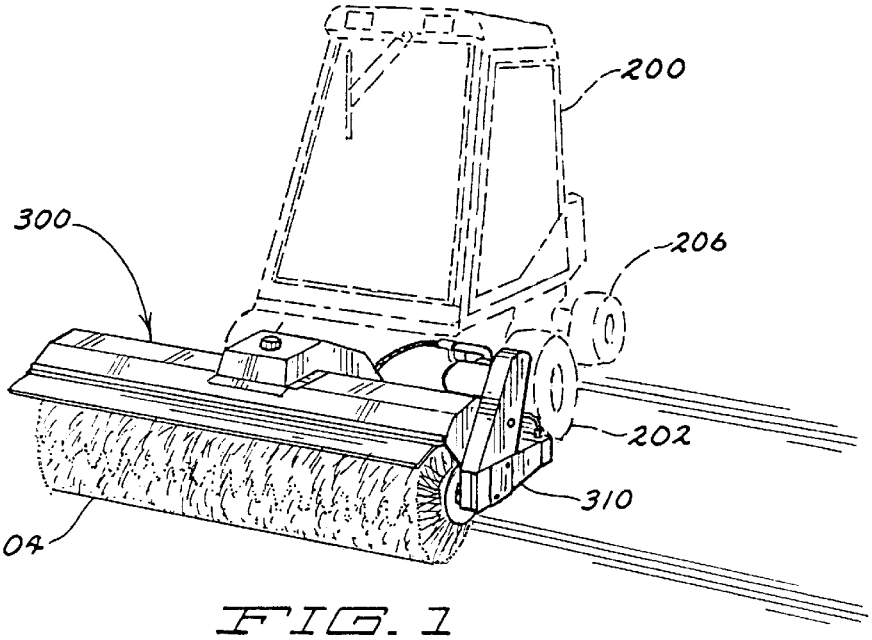
FIG. 1 is a perspective view of a rotary sweeper as attached to a traction vehicle.
Figure 2:
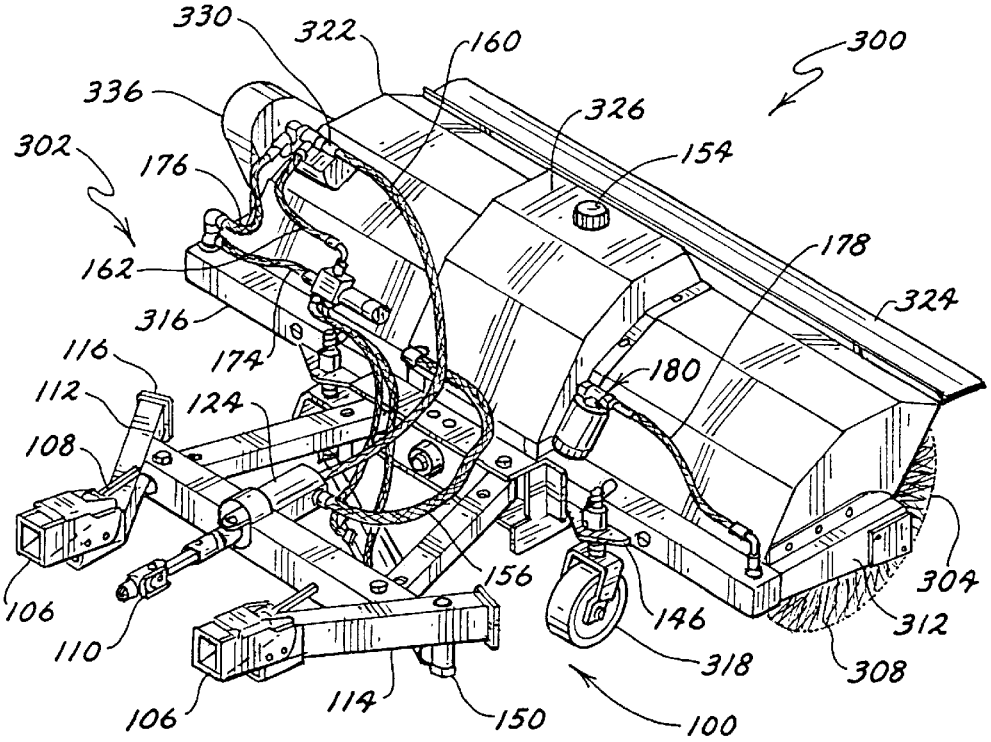
FIG. 2 is a perspective view of the preferred rotary sweeper connecting mechanism of the present invention.
Figure 9:
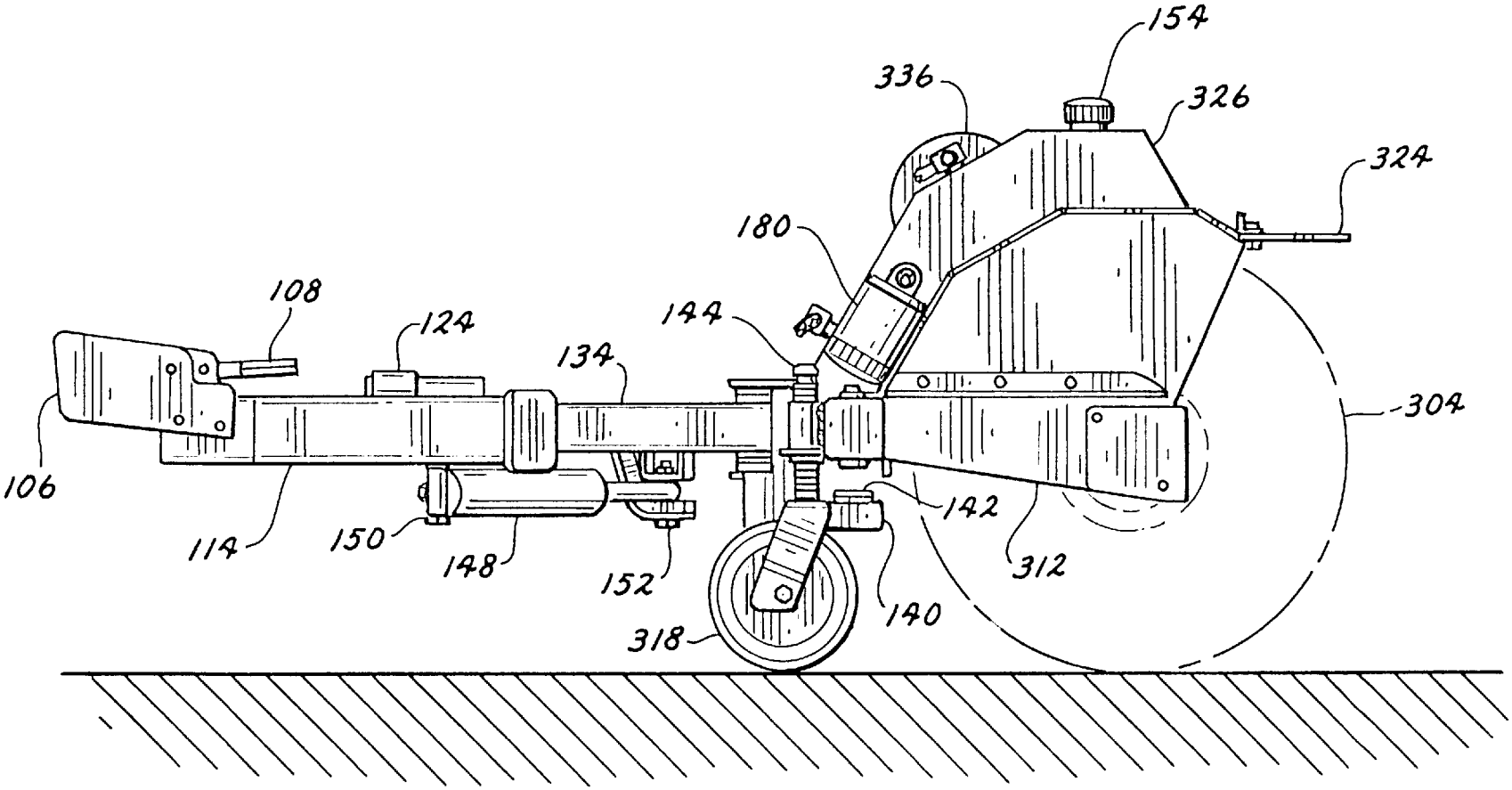
FIG. 9 is a schematic diagram of the range of motion of the prior art connecting mechanism.
Figure 4:
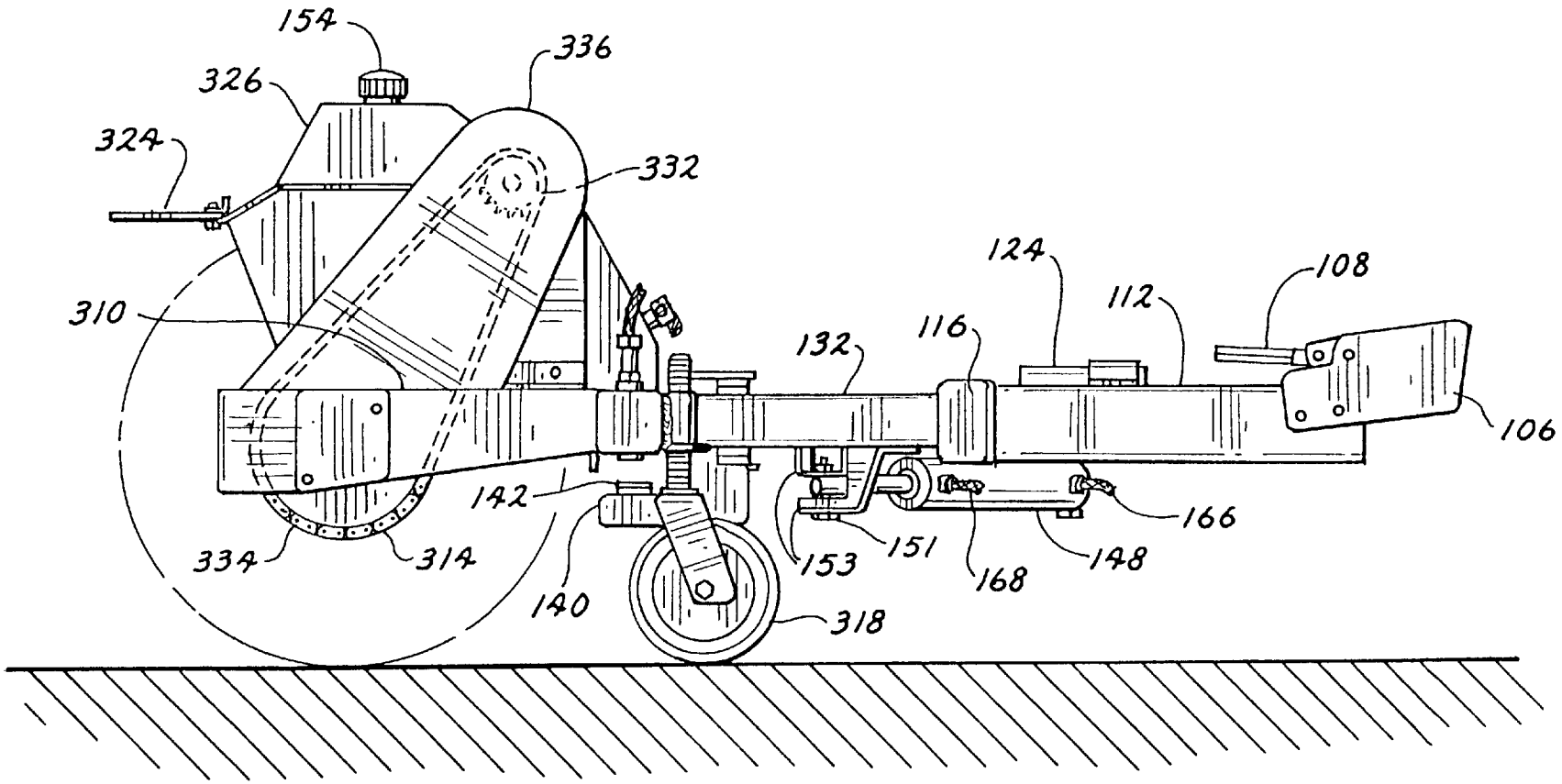
FIG. 4 is an enlarged left side view of the rotary sweeper connecting mechanism of FIG. 2, showing the brush drive system.
Figure 5:
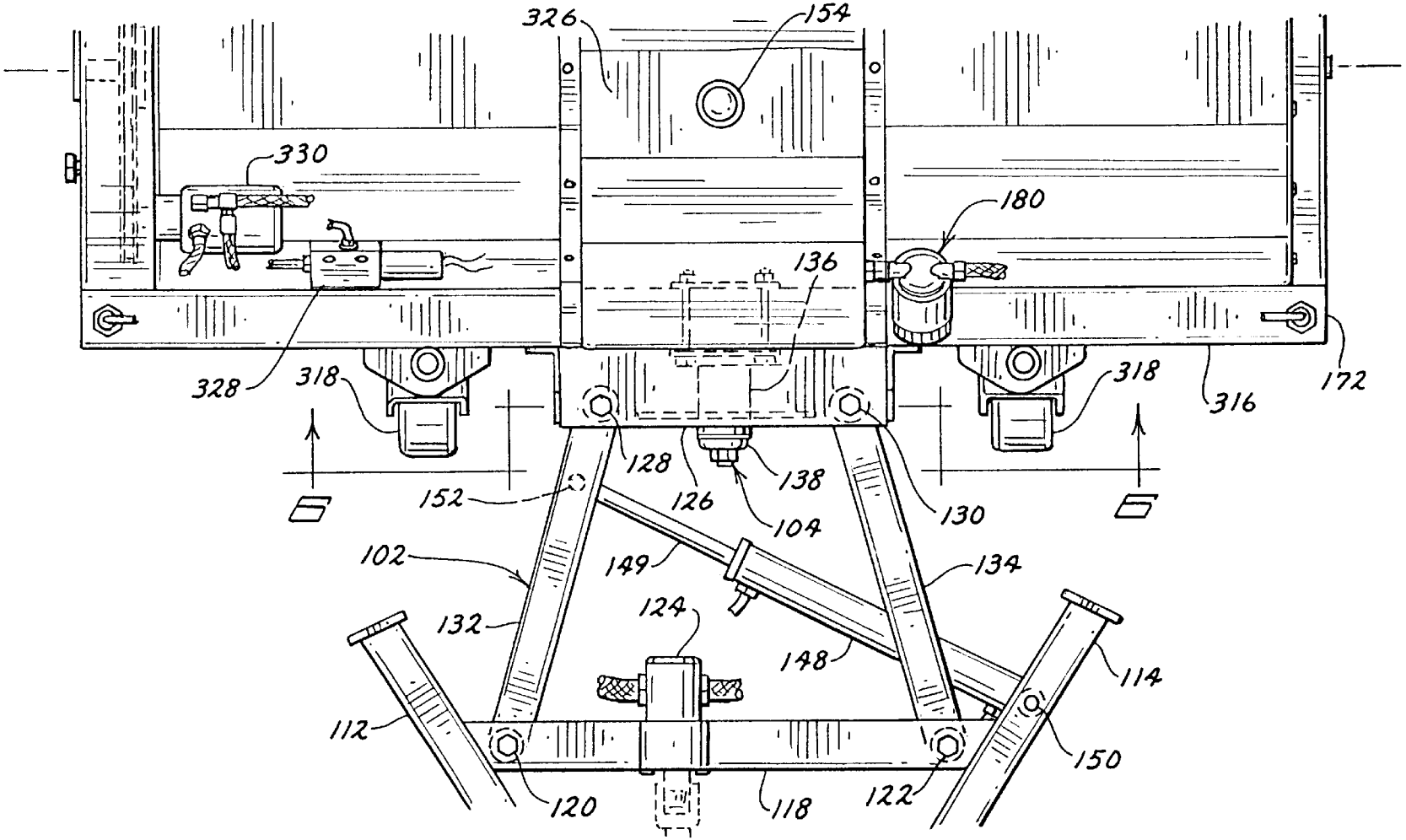
FIG. 5 is an enlarged top plan view of the rotary sweeper connecting mechanism of FIG. 2.
Figure 6:
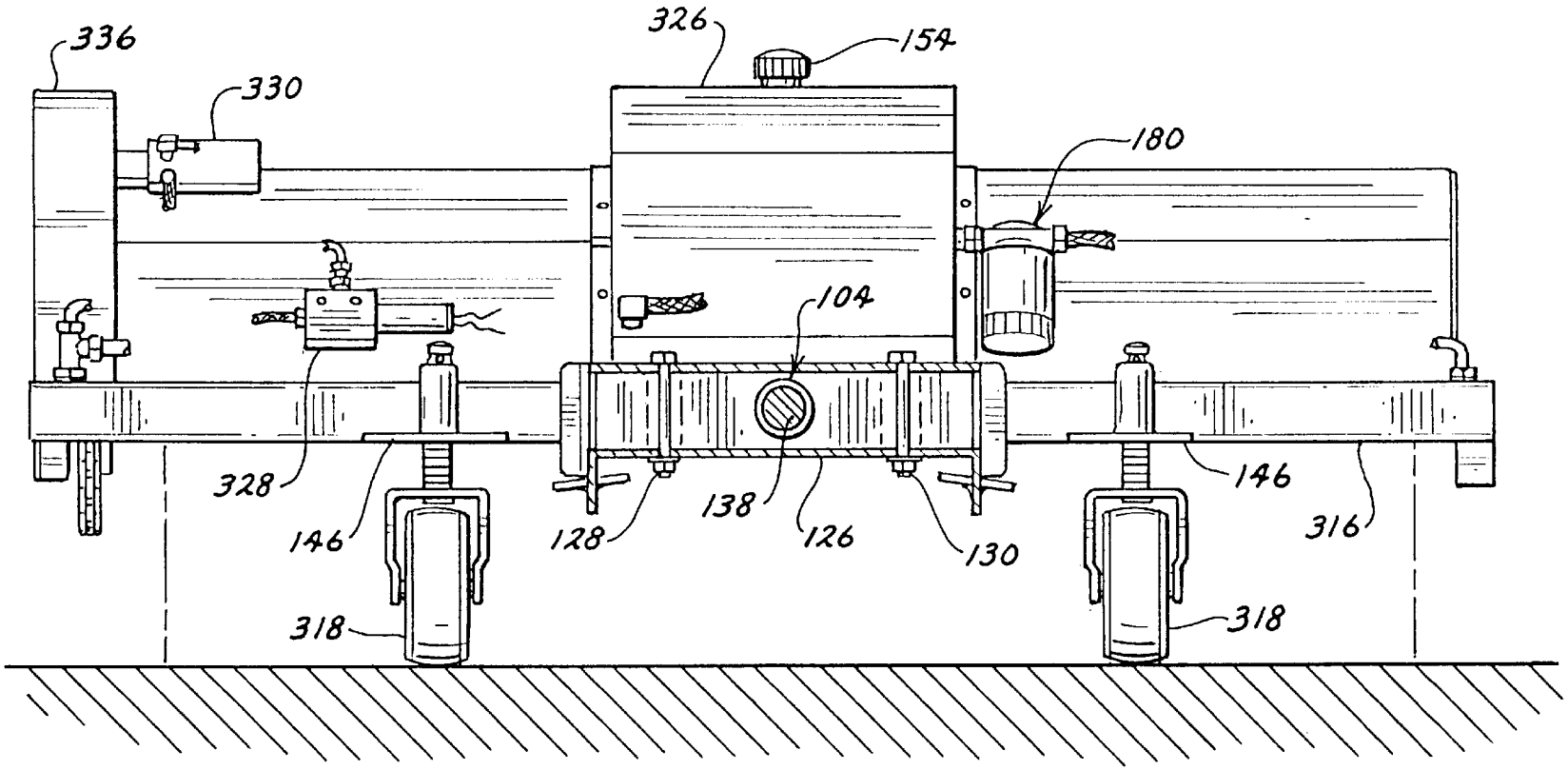
FIG. 6 is an enlarged rear sectional view of the rotary sweeper connecting mechanism of FIG. 2.

With reference to the Drawings, wherein like reference numerals designate like parts and assemblies throughout the several views, FIG. 2 shows a perspective view of a preferred connecting mechanism 100 according to the present invention. Referring generally to FIG. 1, the connecting mechanism connects a traction vehicle 200 to a transverse rotary sweeper 300. Traction vehicle 200 is preferably a ground maintenance vehicle generally of the type represented by the Groundsmaster® 3000 sold by The Toro Company, assignee herein; but those skilled in the art will appreciate that the present invention could be adapted for use with other types of vehicles. Likewise, while the implement is described as a front-mounted rotary sweeper, the connecting mechanism described may be adapted for use with other surface maintenance implements (e.g., dozer blades, grass dethatchers) and other mounting configurations (e.g., rear-mounted or mid-mounted implements). Although the details of the traction vehicle and rotary sweeper are, for the most part, not central to the invention, the basic components of each will be described. To simplify the description, an implement assembly 302 is operatively defined as the combination of rotary sweeper 300 and connecting mechanism 100.

Referring generally to FIG. 1, traction vehicle 200 is supported by a pair of front drive wheels 202 coupled through a transmission (not shown) to a prime mover (also not shown). A power take-off (PTO) shaft (not shown), also connected to the prime mover through a transmission, extends from the front of vehicle 200. Structural attachment of implement assembly 302 to the vehicle and lifting thereof is provided by a pair of lift arms (not shown). The lift arms pivot or "pitch" about a lateral pivot axis (not shown) located underneath the vehicle. Means for pitching and lifting implement assembly 302 is therefore incorporated into traction vehicle 200 and is not part of the present invention per se. Finally, a set of rear steerable wheels 206 which may or may not be powered, supports the rearward end of vehicle 200.

Rotary sweeper 300 comprises a series of disk-shaped, radial brushes 304 aligned on a common, horizontal brush shaft 306. Brush shaft 306 forms the axis of rotation of rotary sweeper 300. Each brush is comprised of a plurality of flexible filaments 308 extending radially outward from the brush shaft. A left side arm 310 and a right side arm 312 rotatably support brush shaft 306 and are located at opposite ends thereof. Brush shaft 306 accommodates the coaxial mounting of a driven gear 314 proximate to left side arm 310. Side arms 310 and 312 are spanned at the rear of the sweeper by a rear frame 316. That is, side arms 310 and 312 and rear frame 316 form a generally "C"-shaped frame. While rear frame 316 is preferably a square frame (i.e., of square cross-section), the precise cross-sectional shape is not critical. A pair of ground-contacting caster wheels 318 support the weight of the sweeper assembly, thus reducing the weight sustained by brushes 304 during operation. Thus, rotary sweeper 300 is a partially self-supporting unit (when in its lowered operating position) which is pushed across the ground on caster wheels, the rotating sweeper of which is powered by traction vehicle 200.

Rotary sweeper 300 also includes a cover 322 which spans the length of the sweeper and is generally concentric with brushes 304. The rear edge of cover 322 terminates at square frame 316 and the front edge terminates generally forward of a vertical plane passing through brush shaft 306. In addition to helping confine and direct debris during the sweeping operation, cover 322 also serves as a safety shield to prevent debris discharge toward the operator. An optional lip shield 324 can be used to forwardly extend cover 322. Mounted to the cover is a hydraulic reservoir 326 and a solenoid valve body 328. A hydraulic motor 330, as shown in the drawings, is actually mounted to a structural extension (not shown) of square frame 316. A drive gear 332 is connected directly to the output shaft of hydraulic motor 330 and operatively connected to driven gear 314 by a chain 334. A chain guard 336 covers drive gear 332, driven gear 314, and chain 334. During operation, hydraulic motor 330 rotates brush shaft 306 counterclockwise as viewed in FIG. 3. Debris is therefore discharged both forward of the sweeper and perpendicular to brush shaft 306.

Connecting Mechanism

Having described traction vehicle 200 and rotary sweeper 300 in some detail, attention will now be focused on the connecting mechanism. Connecting mechanism 100 is intermediate to vehicle 200 and rotary sweeper 300 and is centrally located about the longitudinal axis of the vehicle. In the preferred embodiment, the connecting mechanism comprises: a four-bar linkage 102 attached to traction vehicle 200; and a central pivot 104 which is operatively connected to both four-bar linkage 102 and rotary sweeper 300 (those skilled in the art will readily realize that central pivot 104 could also be located intermediate to the vehicle and the four-bar linkage). As with other connecting mechanisms, it is desirable to provide a simple method for quickly attaching and removing implement assembly 302 from the traction vehicle. Thus, a pair of lift arm receivers 106 extend rearwardly from connecting mechanism 100. Each lift arm receiver slidably receives one of the vehicle lift arms and, through simple operator manipulation of a lever 108, rigidly attaches implement assembly 302 to vehicle 200. To complete the attachment, a pump input shaft 110 is operatively connected to the PTO shaft (not shown) and an electrical harness (also not shown) is connected to a receiving plug (also not shown) on vehicle 200.

A left base support rail 112 and a right base support rail 114 extend forwardly and outwardly from lift arm receivers 106. The forward end of each base support rail forms a mechanical stop 116 which prevents translation of the sweeper beyond a defined maximum yaw position. A base 118 spans the base support rails. The base forms the "fixed" link of four-bar linkage 102. A left base pivot 120 and a right base pivot 122 are located at opposite ends of base 118. A hydraulic pump 124, operatively coupled to input shaft 110, is centrally located on the upper side of base 118. Thus, lift arm receivers 106, left base support 112, right base support 114, base 118, and hydraulic pump 124 are fixed in relation to one another.

A crossbar 126 lies forward of base 118. When the four-bar linkage is in a centered position (i.e., at "zero" yaw angle), crossbar 126 is substantially parallel to base 118. A left crossbar pivot 128 and a right crossbar pivot 130 are located at respective ends of crossbar 126. A left link 132 extends forwardly and inwardly (again, when the four-bar linkage is centered) from pivot 120 to pivot 128. A right link 134 extends forwardly and inwardly from pivot 122 to pivot 130. Thus, base 118, links 132 and 134, and crossbar 126 operatively define a four-bar linkage. To reduce friction at pivot joints, 120, 122, 128, and 130, conventional bearings/bushings can be used.

Located centrally on the front of crossbar 126 is an aperture 136. A pivot pin 138, which is rigidly attached to the center of square frame 316 and extends rearwardly therefrom, is positively but pivotably retained within aperture 136 so that square frame 316 (and thus rotary sweeper 300) remains in rotational engagement with crossbar 126 at all times. Referring to FIG. 3, crossbar 126 also includes a pair of forwardly extending pivot stops 140. Connected to the upper outermost ends of each pivot stop 140 is a resilient bumper 142 which physically limits rotation (rolling) of the sweeper about central pivot 104 by physically restraining movement of square frame 316 beyond a defined angular displacement relative to crossbar 126. In other words, rotary sweeper 300 may pivot about central pivot 104 during operation. Accordingly, the problem of effectively sweeping laterally uneven terrain that was so evident in the prior art four-bar linkage is dramatically reduced by the present invention. Similarly, unlike the prior art four-bar linkage, central pivot 104 of the present invention permits consistent brush/ground contact regardless of brush diameter or yaw position.

Figure 10:
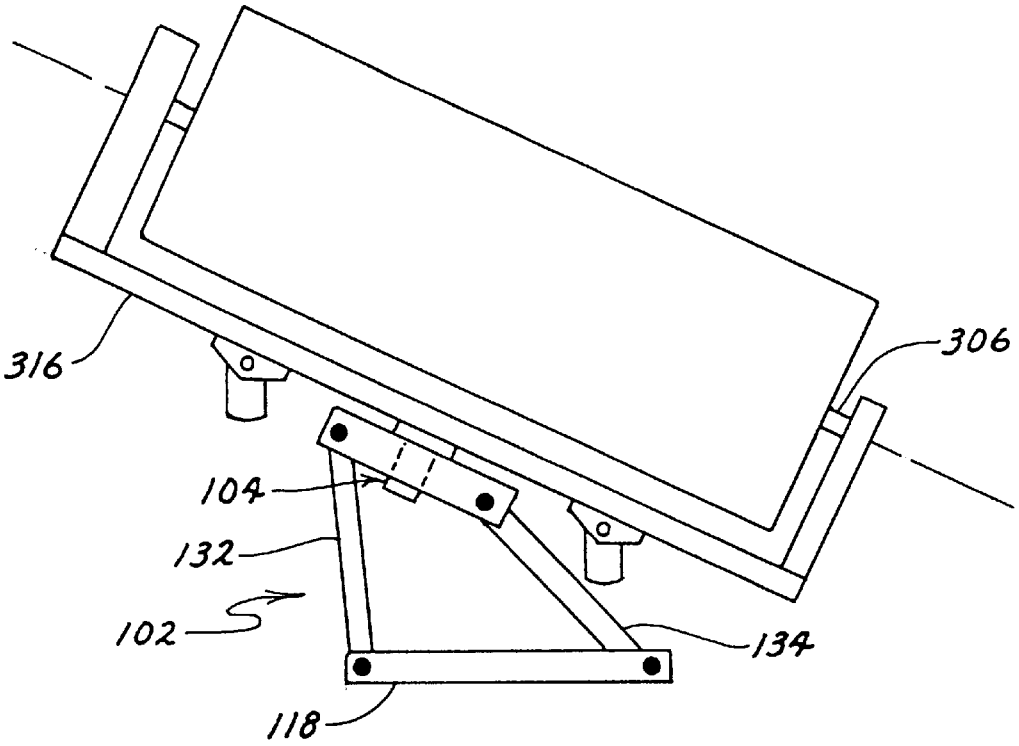
FIG. 10 is a top plan view of the rotary sweeper connecting mechanism of FIG. 2 in a yawed position after the sweeper brushes have experienced wear.
Figure 10A:
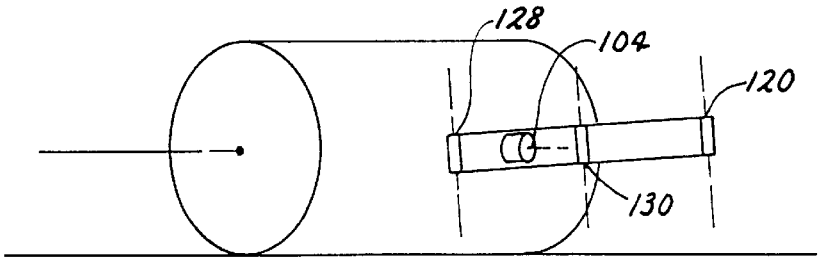
FIG. 10A is a side elevation view of the rotary sweeper of FIG. 10.
Figure 10B:
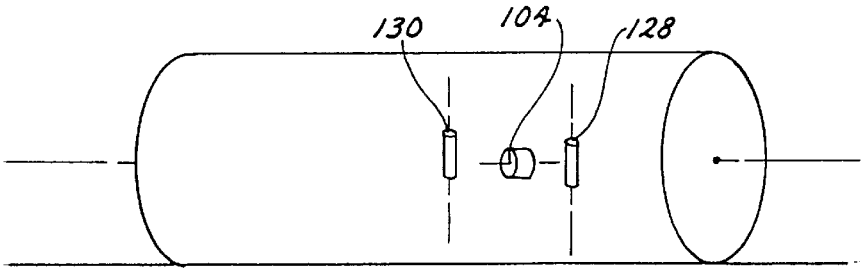
FIG. 10B is a front view of the rotary sweeper of FIG. 10.
Figure 11A:
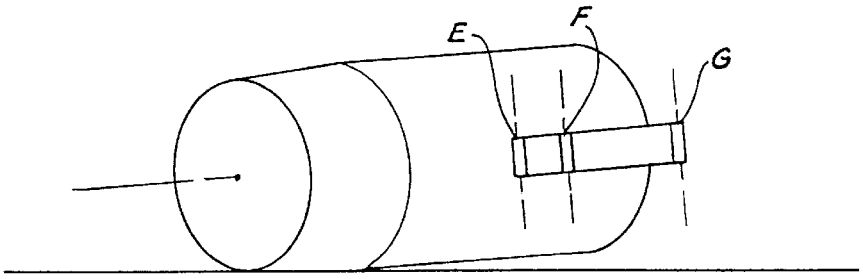
FIG. 11A PRIOR ART
FIG. 11A is a side elevation view of the sweeper of FIG. 11.
Figure 11B:
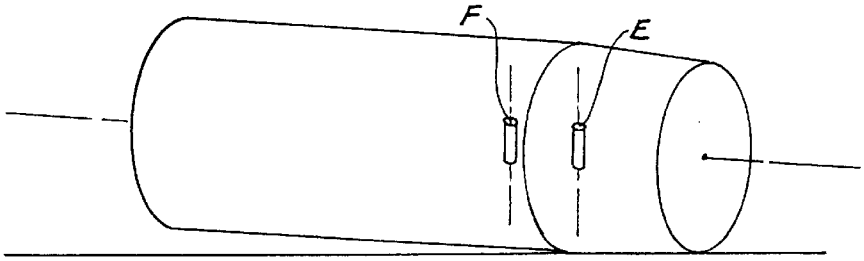
FIG. 11B PRIOR ART
FIG. 11B is a front view of the sweeper of FIG. 11.
Figure 12:
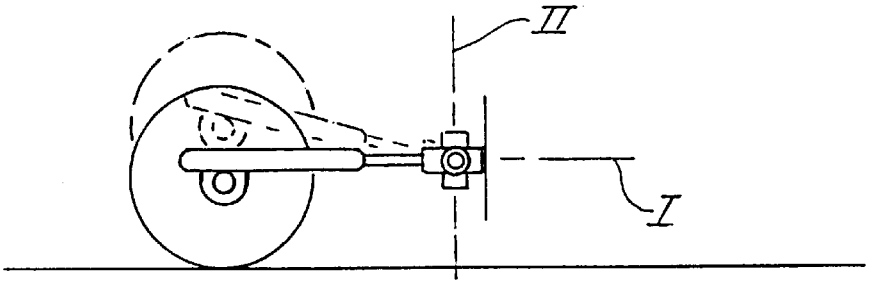
FIG. 12 PRIOR ART
FIG. 12 is a side view of the prior art simple vertical axis pivot mechanism.
Figure 13:
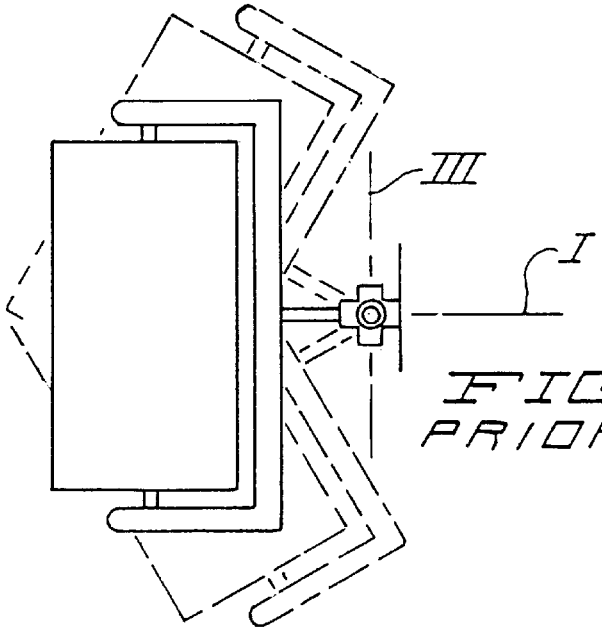
FIG. 13 PRIOR ART
FIG. 13 is a top plan view of the prior art simple vertical axis pivot mechanism.
Figure 14:
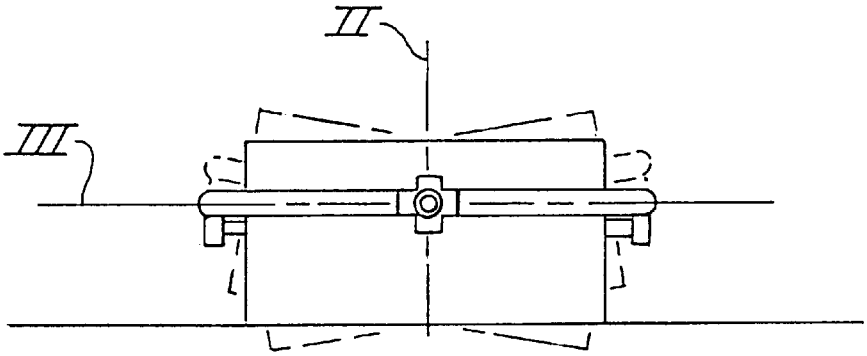
FIG. 14 PRIOR ART
FIG. 14 is a front view of the prior art simple vertical axis pivot mechanism.

From FIG. 3, the plane of four-bar linkage 102 is substantially parallel to the ground when unworn (i.e., new) brushes are installed and the height of caster wheels 318 is set to provide optimal brush contact. However, as previously discussed, the brushes are subject to constant wear. As a result of this wear, it is necessary to periodically lower sweeper assembly 300 to ensure correct ground pressure. FIG. 10A shows the preferred embodiment of the present invention after it has been lowered (note that FIG. 10A also shows the sweeper in a yawed state). Lowering is accomplished by first pitching or raising the sweeper to its transport position. This relieves the weight on caster wheels 318. An integral shank 144 extends upward from each caster wheel and engages a frame support 146. Shank 144 provides incremental adjustment to permit raising and lowering the caster wheels relative to support 146. Accordingly, caster wheels 318 can be vertically adjusted to lower (or raise) the rotary sweeper relative to the ground, thus maintaining optimal brush contact pressure.

A double-acting hydraulic cylinder 148 having a rod 149 is mounted between right base support 114 and left link 132. It should be noted that while this embodiment describes a hydraulic cylinder, other force-producing devices including but not limited to pneumatic cylinders and electric ball screws are also contemplated. Upon operator command, rod 149 can be extended or retracted relative to hydraulic cylinder 148 (this extension/retraction motion is hereinafter referred to as extension/retraction of hydraulic cylinder 148 itself), causing four-bar linkage 102 to yaw rotary sweeper 300 to the right or left respectively. A base end pivot 150 secures the base end of cylinder 148 to the right base support 114 and a rod end pivot 152 secures the rod end of the cylinder to left link 132. Both attach points 150 and 152 are pivotable joints that allow translation of four-bar linkage 102 without inducing side load into cylinder 148.

When the rotary sweeper is translated to its maximum yaw position, square frame 316 contacts mechanical stop 116, preventing further yawing. In addition to limiting the yaw of the sweeper, stops 116 also provide additional structural rigidity to connecting mechanism 100. This additional support is beneficial when extraneous loading is introduced into the connecting mechanism, such as when the sweeper strikes an immovable object. However, when the sweeper is in any but the fully yawed position, this additional support is not present as stops 116 are no longer in contact with square frame 316. In that case, any extraneous loading must be reacted through hydraulic cylinder 148. When the cylinder is exposed to extraneous loads, the hydraulic pressure within the cylinder increases. If this pressure exceeds the rated pressure of the hydraulic cylinder, damage may occur to the cylinder and its related structure. As such, pivot joint 152 of the preferred embodiment is a "break-away" assembly designed to fail before overpressurization or structural damage occurs. That is, a pin 151, which passes through a clevis 153 and through cylinder rod 149, will shear before the cylinder exceeds its rated capacity. When pin 151 fails, the cylinder rod separates from the four-bar linkage, thus minimizing damage to the connecting mechanism and the hydraulic actuator. While this embodiment shows a shear pin as the break-away assembly, those skilled in the art will realize that a hydraulic relief valve could also be utilized to prevent cylinder overloading. However, concerns with valve response time, cost, and differential volume between extension and retraction sides of cylinder 148 may make this latter alternative less attractive.

Figure 8:
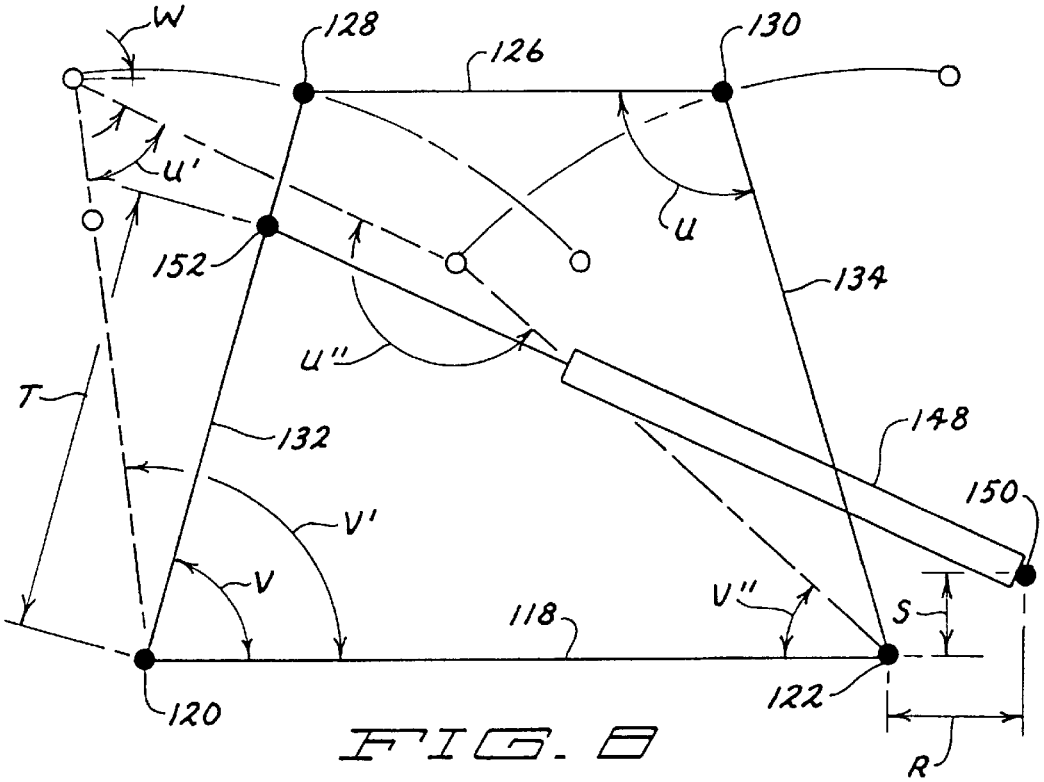
FIG. 8 is a schematic diagram of the range of motion of the connecting mechanism of FIG. 2.
Figure 9:
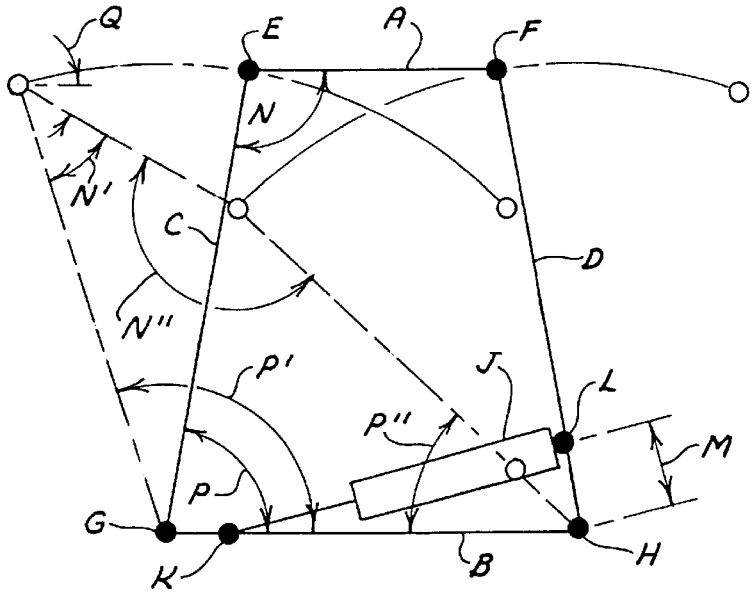
FIG. 9 PRIOR ART
Figure 11:
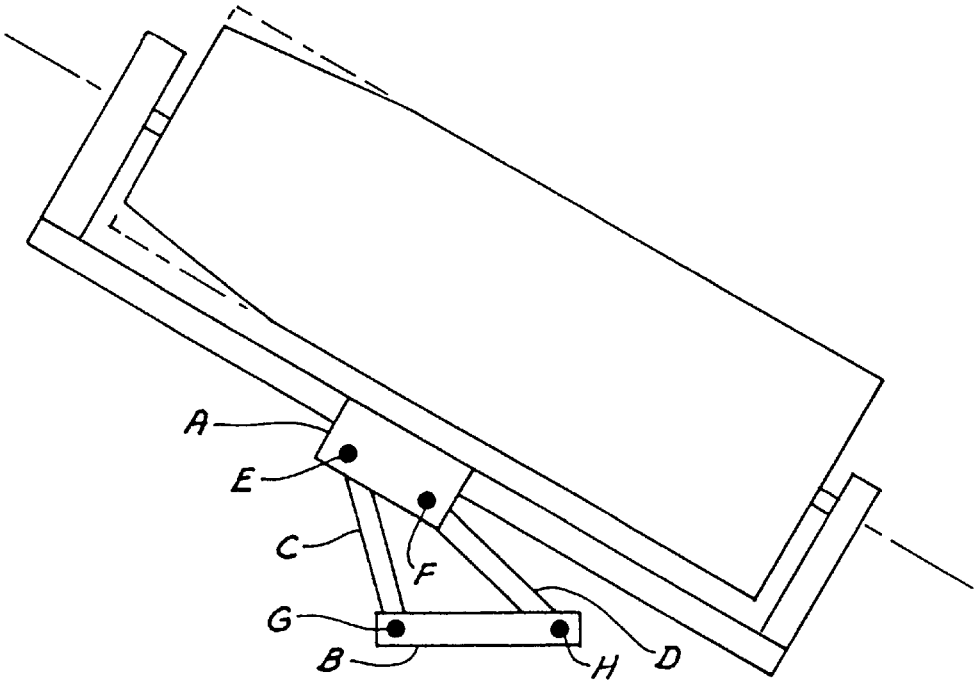
FIG. 11 PRIOR ART
FIG. 11 is a top plan view of the prior art four-bar linkage rotary sweeper connecting mechanism in a yawed position after the sweeper brushes have experienced wear.

Referring to the drawings and to FIG. 8 particularly, rod end pivot 152 is pivotably mounted to link 132 distally from left base pivot 120. While this requires a longer stroke cylinder than proximate mounting to pivot 120 would require, it also provides greater mechanical advantage and thus, a lower extension/retraction threshold pressure. By attaching base end pivot 150 to right base support 114 instead of to base 118, cylinder 148 remains in a generally perpendicular relationship to left link 132. Accordingly, hydraulic cylinder 148 of the preferred embodiment provides improved mechanical advantage while maintaining the desired perpendicular relationship to left link 132. Referring to Table V (below) and FIG. 8, the preferred lengths, dimensions, and angular relationships of the elements are shown. Those skilled in the art will realize that embodiments employing different dimensions than those listed in Table V are also within the scope of the invention.

TABLE V

FIG. 8
Dimensional Data

| Item | Value |
|---|---|
| 126 | 15.25 in |
| 118 | 27.00 in |
| 132, 134 | 22.00 in |
| R | 5.10 in |
| S | 2.60 in |
| T | 17.00 in |
| U | 105° |
| U' | 58° |
| U" | 160° |
| V | 75° |
| V' | 96° |
| V" | 44° |
| W | 25° |

Hydraulic Subsystem

Figure 7:
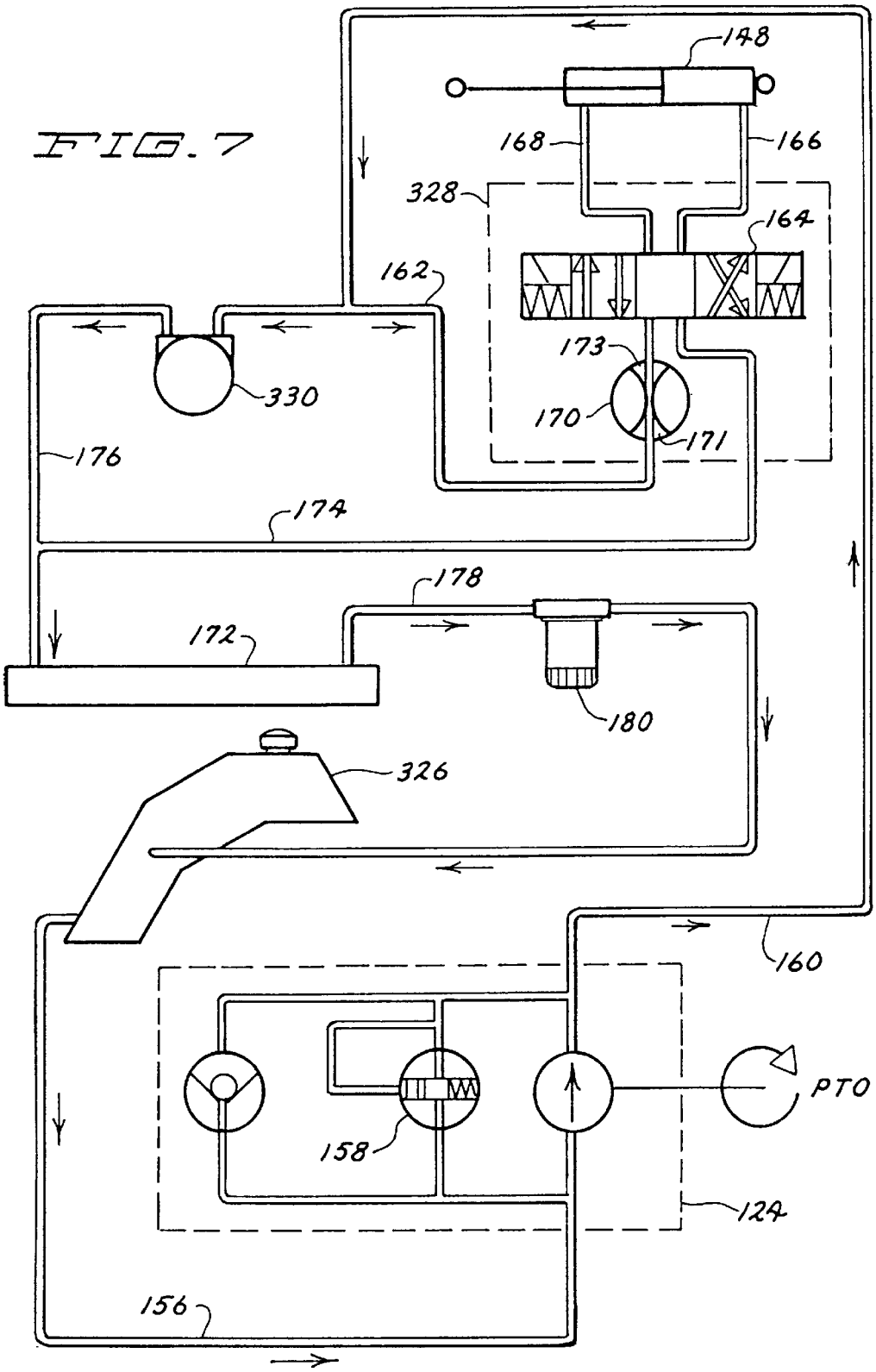
FIG. 7 is a schematic diagram of a preferred hydraulic circuit for the connecting mechanism of FIG. 2 and the sweeper itself.

Having described the connecting mechanism in detail, attention will now be focused on the hydraulic subsystem as shown in FIG. 7. While the preferred embodiment incorporates a separate hydraulic subsystem, embodiments utilizing other hydraulic systems (i.e., that available from traction vehicle 200) are also contemplated. Reservoir 326 is mounted approximately at the top center of cover 322, although it may be mounted off-center if counter-balancing of the sweeper about central pivot 104 is required. The reservoir is filled with a compatible hydraulic fluid (not shown) through a filler cap 154. Unpressurized fluid is drawn from the reservoir by hydraulic pump 124 through a first flexible hose 156. Pump 124 is a conventional fixed-volume gear pump with a relief valve 158. Pressurized fluid is ported from hydraulic pump 124 to hydraulic motor 330 by a second hose 160. From there, a third hose 162 carries pressurized fluid to solenoid valve body 328. A three-position solenoid valve 164 is mounted within solenoid valve body 328. Solenoid valve 164 controls hydraulic flow to and from hydraulic cylinder 148. In its de-energized state (shown in FIG. 7), solenoid valve 164 shuts off all flow to and from the cylinder. This effectively "locks" the cylinder in position. When the operator desires to yaw the sweeper to the right, a switch (not shown) is actuated which commands the solenoid valve to a first energized state. Here, pressurized fluid is ported to the base side of cylinder 148 through a fourth hose 166, forcing the cylinder to extend. Hydraulic fluid from the rod side of cylinder 148 is simultaneously ported out of the cylinder by a fifth hose 168. To yaw the sweeper to the left, the operator selectively actuates the switch to command the solenoid to a second energized state. Here, pressurized fluid is ported to the rod side of cylinder 148 through hose 168, forcing it to retract and yaw the sweeper to the left. Hydraulic fluid from the base side of cylinder 148 is simultaneously ported out of the cylinder by hose 166. The operator can stop the sweeper at any intermediate position by releasing the switch. To meter the flow of fluid to the hydraulic cylinder and the solenoid valve, an orifice 170 is provided within solenoid valve body 328. Hydraulic fluid enters the orifice through an inlet side 171 and exits the orifice through an outlet side 173. The orifice 170 restricts flow, effectively limiting the extension/retraction speed of cylinder 148. Ideally, this orifice is 0.060 inch diameter. In the preferred embodiment, hydraulic hoses 162, 166, 168, and 174 are 0.375 inch internal diameter, effectively permitting unrestricted flow. However, those skilled in the art will recognize that careful hose size selection may also provide the desired pressure drop, obviating the need for the orifice.

In the preferred embodiment, a sealed, hollow cavity created within square frame 316 forms an oil cooler 172. A sixth and seventh hose 174 and 176 port return flow from solenoid valve body 328 and hydraulic motor 330 respectively, into oil cooler 172. The surface area provided by square frame 316 allows the hydraulic fluid within oil cooler 172 to cool before returning to reservoir 326, thus preventing overheating of the hydraulic system. A final flexible hose 178 connects cooler 172 to a conventional return-line hydraulic filter 180 which is, in turn, directly attached to reservoir 326. Thus, implement assembly 302 includes a self-contained hydraulic subsystem powered by traction vehicle 200.

Preferred embodiments of the invention are described above. Those skilled in the art will recognize that many embodiments are possible within the scope of the invention. Variations and modifications of the various parts and assemblies can certainly be made and still fall within the scope of the invention. Thus, the invention is limited only to the apparatus and method recited in the following claims, and equivalents thereto.

We claim:

1. A connecting mechanism for attaching a ground-engaging surface maintenance implement to a forward portion of a traction vehicle, wherein the implement is suitable for maintaining a ground surface, the connecting mechanism comprising:

a) a translatable four-bar linkage oriented in a plane substantially parallel to the ground surface, which permits yawing of the implement relative to the vehicle; and b) a central pivot operatively connected to the four-bar linkage, wherein the central pivot permits rolling of the implement relative to the vehicle.

2. A connecting mechanism for attaching a transverse rotary sweeper to a forward portion of a traction vehicle, the rotary sweeper having an axis of rotation, and wherein the sweeper is suitable for maintaining a ground surface, said connecting mechanism comprising:

a) a translatable four-bar linkage oriented in a plane substantially parallel to the ground surface; which permits yawing of the sweeper relative to the vehicle;

b) a central pivot operatively connected to the four-bar linkage, wherein the central pivot permits rolling of the sweeper relative to the vehicle; and c) means for connecting the four-bar linkage to the forward portion of the traction vehicle.

3. The connecting mechanism of claim 2, wherein the central pivot is interposed between the sweeper and the four-bar linkage.

4. A rotary sweeper assembly for attaching to the front of a traction vehicle, the vehicle having a longitudinal axis, wherein the rotary sweeper assembly is suitable for sweeping a ground surface, and wherein the rotary sweeper assembly comprises:

a) a transverse rotary sweeper having a plurality of radial brushes mounted to a common brush shaft, the brush shaft having an axis of rotation;

b) a translatable four-bar linkage oriented in a plane substantially parallel to the ground, which permits yawing of the sweeper relative to the vehicle, wherein the linkage comprises a base which can be secured to the front of the traction vehicle; and c) a central pivot operatively connected to the four-bar linkage, wherein the central pivot permits rolling of the sweeper relative to the vehicle.

5. The rotary sweeper assembly of claim 4, wherein the central pivot is interposed between the sweeper and the four-bar linkage.

6. The rotary sweeper assembly of claim 5, wherein the rotary sweeper further comprises at least two ground-contacting, vertically adjustable caster wheels.

7. The rotary sweeper assembly of claim 6, wherein the base is a transverse member having a left and a right end, the base being centrally located about the longitudinal axis of the vehicle, and wherein the four-bar linkage, in a centered position, further comprises:

a) a front crossbar having a left and a right end, the crossbar being substantially parallel to the base and centrally located abut the longitudinal axis;

b) a left link having a forward and a rearward end, the rearward end being pivotably attached to the left end of the base, the front end extending forwardly and inwardly and pivotably attaching the left end of the front crossbar; and c) a right link of equal length to the left link, having a forward and a rearward end, the rearward end being pivotably attached to the right end of the base, the front end extending forwardly and inwardly and pivotably attaching to the right end of the front crossbar.

8. The rotary sweeper of claim 7, wherein:

a) the base is approximately 27 inches long;

b) the left and right links are symmetrical about the longitudinal axis and are about 22 inches long, wherein each link forms an angle of about 75 degrees with the base; and c) the crossbar is about 15 inches long.

9. The rotary sweeper assembly of claim 7, further comprising a means for translating the four-bar linkage.

10. The rotary sweeper of claim 9, wherein the translating means comprises a break-away assembly intermediate to the translating means and the rotary sweeper, wherein during normal operation the break-away assembly permits the translating means to maintain the position of the four-bar linkage but when the rotary sweeper contacts an immovable object the breakaway assembly allows separation of the translating means from the rotary sweeper to prevent damage thereto.

11. The rotary sweeper assembly of claim 10, wherein the translating means is a linear actuator.

12. The rotary sweeper assembly of claim 11, wherein the linear actuator is a hydraulic cylinder.

13. The rotary sweeper assembly of claim 12, further comprising:

a) a hydraulic reservoir containing a suitable volume of hydraulic fluid;

b) a hydraulic motor operatively connected to the brush shaft to provide rotation thereto;

c) a hydraulic pump suitable for connecting to the hydraulic motor and the hydraulic cylinder, the pump being hydraulically connected to the reservoir such that it can draw unpressurized hydraulic fluid from the reservoir and provide pressurized hydraulic fluid to the motor and the cylinder; and d) a rear frame spanning the back of the rotary sweeper, the rear frame including a sealed hollow cavity wherein the cavity defines an oil cooler located intermediate to the hydraulic motor and cylinder and the hydraulic reservoir.

14. The rotary sweeper of claim 13, further comprising: a three-position solenoid valve intermediate to the hydraulic pump and the hydraulic cylinder, the solenoid valve being selectively energized from a neutral position to a first or a second position, the neutral position being characterized by blocking all hydraulic flow to the cylinder, the first position being characterized by extending the hydraulic cylinder, and the second position being characterized by retracting the hydraulic cylinder.

15. The rotary sweeper of claim 14, further comprising a hydraulic orifice positioned between the solenoid valve and the hydraulic pump, the orifice having a hydraulic inlet and a hydraulic outlet, whereas hydraulic flow over the orifice creates a differential pressure between the inlet and the outlet such that the outlet pressure is less than the inlet pressure.

16. The rotary sweeper of claim 15, wherein the orifice is 0.060 inch diameter.

17. A connecting mechanism for attaching a ground-engaging surface maintenance implement to a traction vehicle, comprising:

a) a translatable four-bar linkage which is trapezoidal in shape in its centered position that permits yawing of the implement relative to the vehicle; and b) a central pivot operatively connected to the four-bar linkage, wherein the central pivot permits rolling of the implement relative to the vehicle.

18. A connecting mechanism for attaching a transverse rotary sweeper to a forward portion of a traction vehicle, the rotary sweeper having an axis of rotation, said connecting mechanism comprising:

a) a translatable four-bar linkage which is trapezoidal in shape in its centered position that permits yawing of the sweeper relative to the vehicle; and b) a central pivot operatively connected to the four-bar linkage, wherein the central pivot permits rolling of the sweeper relative to the vehicle.

* * * * *